United States Patent [19]

Conrad et al.

[11] Patent Number: 5,062,716

[45] Date of Patent: Nov. 5, 1991

[54] STAGED RELEASE BAG AND METHOD FOR MAKING

[75] Inventors: Daniel J. Conrad; Jerry W. Davenport, both of Murfreesboro, Tenn.; Robert R. Isen, Philadelphia, Pa.; Michael A. Bullock, Murfreesboro, Tenn.; Wilfred E. Riddell, Neenah, Wis.

[73] Assignees: Kimberly-Clark Corp., Neenah, Wis.; Paramount Packaging Corp., Chalfont, Pa.

[21] Appl. No.: 490,014

[22] Filed: Mar. 7, 1990

[51] Int. Cl.[5] ..... B65D 33/06

[52] U.S. Cl. ..... 383/9; 383/22; 206/554

[58] Field of Search ..... 383/9, 10, 24, 22; 206/554

[56] References Cited

U.S. PATENT DOCUMENTS 3,312,339 4/1967 Million ..... 206/554 X
4,781,474 11/1988 Sengewald ..... 206/554 X

FOREIGN PATENT DOCUMENTS 690150 7/1964 Canada ..... 206/554
851553 9/1970 Canada ..... 206/554

*Primary Examiner*—Stephen Marcus
*Assistant Examiner*—Jes F. Pascua
*Attorney, Agent, or Firm*—Lawrence A. Husick; Robert F. Zielinski; Daniel H. Golub

[57] ABSTRACT

The present invention comprises a novel staged release bag formed of a generally thermoplastic film material preferably having multiple layers and having discrete cuts formed therein including wickets holes, stabilizing cuts and release paths, and which is useful in an automated packaging operation, and a method for making said bag from a continuous tube or sheet of plastic material.

11 Claims, 10 Drawing Sheets

STAGED RELEASE BAG AND METHOD FOR MAKING

BRIEF SUMMARY OF THE INVENTION

This invention is directed generally to releasable bags used in automated packaging processes and to a method for making such bags. Specifically, the instant invention relates to a wicketed bag constructed in a manner to more fully open in stages during its loading. This staging also facilitates the release of a bag from mandrels on a filling machine by the application of reduced and substantially constant forces.

BACKGROUND OF THE INVENTION

Bags used in automated filling processes have been known for many years. Traditionally, these bags are produced from continuous sheets or rolls of bag material, typically organic or other plastic material. In many manufacturing processes, a sheet of bag material is folded and sealed to form a continuous flat bag "tube" having an upper and a lower layer. This tube may be further folded or pinched to form multiple layers in, for example, side gusseted bags. The tube may then be again sealed, cut, stamped, separated and stacked on storage wickets for subsequent use in the automated bag filling operation. Storage wickets onto which the newly formed bags are stacked are typically U-shaped pieces of thin rigid material, which fit through aligned wicket openings formed in the bags on the stack.

During bag filling, stacks of bags are transferred from the wickets onto mandrels which make up part of a bag filling mechanism. After the wicket is removed, the bags remain aligned and stacked on the mandrels. Typically, caps are then positioned over the exposed end of each filling mandrel thereby holding the stacked bags in formation so that they may be used in the filling operation.

During the bag loading process, suction cups or other grabbing means separate the upper layers of the bag from the lower layer thereby initiating the opening of the bag. A puff of air delivered through needle and check valve arrangements further opens the bag while the lower layer of the bag remains securely positioned on the filling mandrels. As the bag opens, loader arms unfold within the filling edge of the bag which open the bag completely while a filling arm pushes items into the bag and ultimately pushes the filled bag off of the mandrel. Examples of wicketed bags and their filling are disclosed in Altman, Jr., U.S. Pat. No. 3,044,233; Melin, U.S. Pat. No. 3,797,732; Lieberman, U.S. Pat. No. 3,640,450; Lehmacher, U.S. Pat. No. 3,996,524 and Inagaki, U.S. Pat. No. 4,669,251. These patents relate generally to bags having a single solid "bridge" of bag material positioned between the wicket opening and the edge of the bag. This "bridge" must be broken in order to release the bag from the wicket.

While wicketed bags represent a popular choice among manufacturers in automated filling operations, such bags share a number of problems which heretofore have not been satisfactorily addressed. One such problem stems from the difficulties often associated with opening the bags during machine loading. For example, side gusseted bags, bags with side folds, tube-style bags, and other bags having multiple panels extending in length past a wicket opening, are particularly difficult to open fully during loading because of the interference of the filling mandrels with the movement of the upper layers of these bags. This interference often prevents the bags from opening completely requiring reduced loading operation speeds and occasionally requiring manual intervention.

In addition, known bags used in automated filling operations are problematic because of the substantial and nonuniform forces required to push the filled bag off the mandrel after loading. These forces, typically generated by the filling arm, involve breaking through a bridge portion of the bag material between the wicket opening (positioned on the mandrel) and the edge of the bag. Depending on the particular bag material being used, the force necessary to start the break (the initiation force) will vary substantially as the thickness and the width of the material to be fractured varies. In addition, the distance between the wicket opening and the filling edge of the bag (the width of the material to be fractured) may vary in production bags, due in part to registration or positioning problems which may occur when the wicket opening and other cuts are made. As a result, the forces required to fill the bag, initiate the break and to continue the break (the propagation force) may vary not only from bag to bag but within a given bag. These variations require different forces to be applied for different periods of time in order to fill the bag and ultimately push it off the mandrel at the appropriate time (i.e. after the bag is filled). The variations in forces can be extremely significant for certain types of bag material such as, for example, low density polyethylene which has a propagation force curve which increases with the stretching of the material until a fracture threshold is reached which occurs as the bag is pushed off the mandrel.

Yet another problem associated with wicketed bags of known construction is that the forces required to tear them from the filling mandrel often cause unwanted shards or fragments of bag material to tear and separate from the bag. These fragments are problematic in at least two ways. Loose fragments of polyethylene in a filled package are aesthetically unacceptable, and may even prove to be dangerous in, for example, food packaging applications where they can later be accidentally ingested. Moreover, these fragments often get caught in and jam the bag filling equipment causing significant down time.

The present invention represents a substantial improvement over known wicketed bags. The present invention utilizes a release path for facilitating bag opening and for disengaging the bag from the mandrel. The release path allows a lessened and substantially constant force to effect filling and release.

SUMMARY OF THE INVENTION

The invention herein provides a bag useful in an automated filling environment wherein the bag more fully opens during loading and easily releases after loading with the application of a reduced and substantially uniform force and without the creation of unwanted fragments.

The bag of the present invention is preferably a multilayer type bag which has novel stabilizing and release cuts on at least one layer. In the preferred embodiment, the stabilizing cut is oriented parallel to the filling edge of the bag. This allows layers of the bag to move about the filling mandrel during the filling process and thus affords the bag greater range of motion during filling allowing it to more fully open before the loading arms insert into the filling edge of the bag and while the loading arms unfold within the bag.

The release path comprises a line of perforations preferably oriented perpendicular to the stabilizing cut extending from an end of the stabilizing cut to the filling edge of the bag. Initially, after the bag is partially opened, loading arms enter into and unfold in the filling end of the formed bag. This causes bag material in at least one layer containing the stabilizing cuts to be stressed and fracture along the release path provided therein. At this point, the upper layers of the bag are released and free of the filling mandrels thus enabling the bag to fully open for filling.

After the loading arms unfold, a filling arm pushes product into the opened bag through a bottom closed end of the bag. The filling arm then continues pushing thereby transferring stress to the bag material positioned on the filling mandrels. As pressure is continually applied, bag material between the filling mandrel and the filling edge of the bag tears through the bag material thereby releasing the bag from the filling mandrel.

The bag of the present invention achieves staged release after filling through the use of perforation cuts positioned between the wicket opening and the filling edge of the bag. These perforation cuts allow the bag to tear away from the wicket cleanly and with the application of minimal and substantially constant initiation and propagation forces.

With many materials used for forming bags, such as, for example, low density polyethylene, the initiation force needed to start a tear or fracture from the wicket hole depends on a number of factors, including the thickness and width of the material to be torn or broken. Since production bags are generally of uniform thickness, the determinative factor of the force required to start a tear or break will be the width of bag material between the wicket opening and the filling edge of the bag. For example, a greater initiation force will be required to begin fracturing a two centimeter wide piece of bag material than would be needed to fracture a piece of bag material that is only one centimeter wide.

Another characteristic of low density polyethylene is that its strength increases as it is stretched. Thus, the force required to continue a break or fracture (the propagation force) continuously increases until the bag material is eventually broken through. The uppermost value of this propagation force is the fracture threshold. In the release path of the present invention, the propagation force increases only minimally as the bag material is fractured. As each perforation is sequentially fractured, the propagation force returns to its lower most value. The differences in force characteristics of known bags and the present invention are generally set forth in FIGS. 16 and 17.

As can be seen from FIG. 17, in the present invention the propagation force increases for only a short period of time before returning to its minimum value. The uppermost propagation force value (the fracture threshold) is thereby reduced. Moreover, in contrast to the known single solid bridge structures, the propagation force in the present invention varies over a substantially smaller range because the propagation force increases only minimally from initiation through fracture of each perforation. The forces required for releasing the bag structure of the present invention are thus smaller and more uniform than that required for known bags.

The present invention also relates to a novel method in which the stabilizing and release cuts are formed in side-gusseted bags produced from a continuous tube of material. As the folded and gusseted bag tube proceeds through a bag manufacturing process, a generally wedged shaped die is placed in contact with the interior surface of the gusseted side folds. As the side fold is drawn over the wedge, opposed punch assemblies form the wicket opening and the stabilizing and release cuts.

BRIEF DESCRIPTION OF THE DRAWINGS

Referring now to the drawings.

DETAILED DESCRIPTION OF THE DRAWINGS

Figure 1:
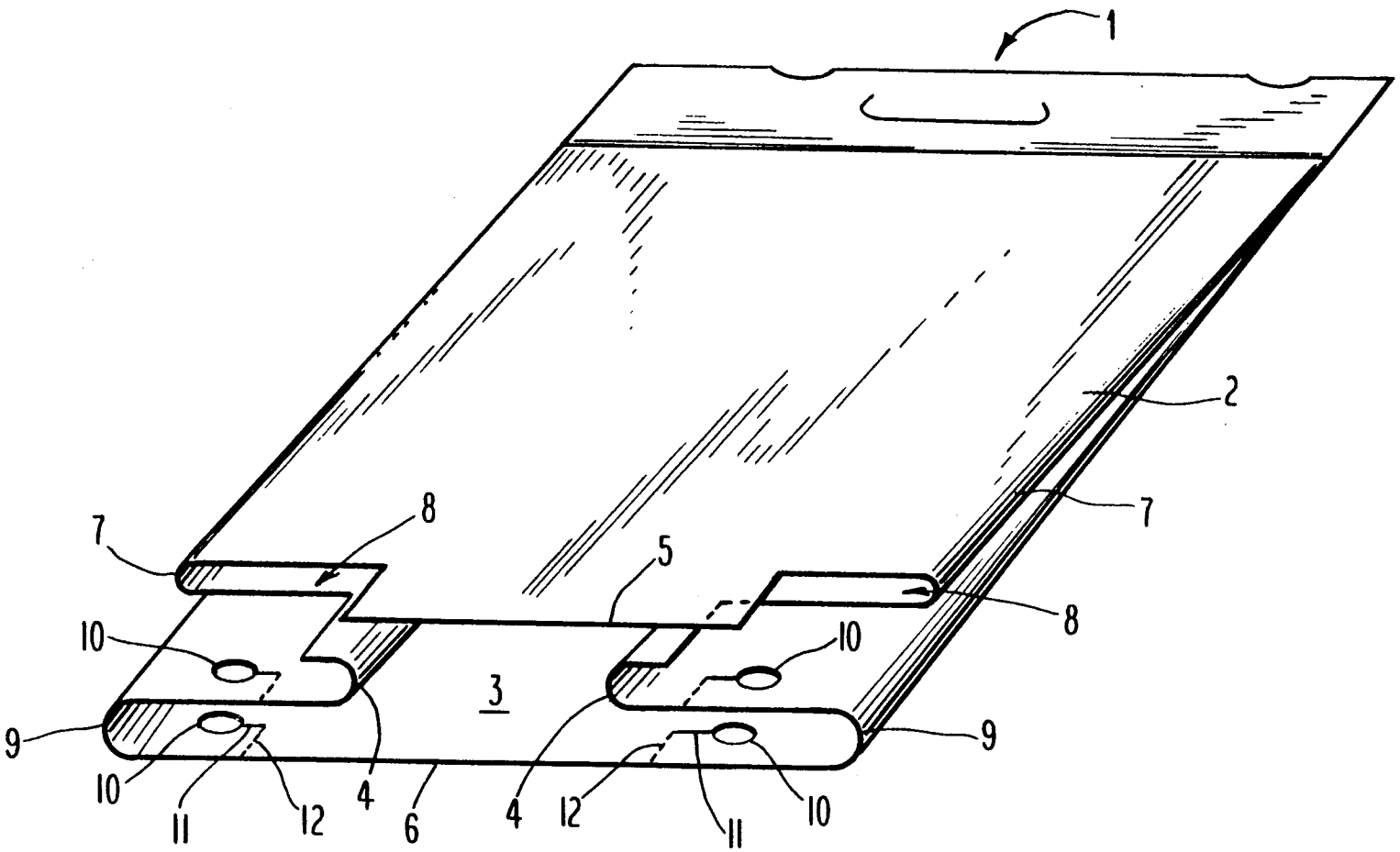
FIG. 1 is a perspective view illustrating the four layers of a side-gusseted bag produced in accordance with the present invention.

FIG. 1 is a perspective view of a side-gusseted bag produced in accordance with the present invention. Bag 1 is a side-gusseted bag having an upper layer 2 and a lower layer 3 separated by gusset fold 4. Upper layer 2 has filling edge 5 positioned across its width and upper side fold 7 extending longitudinally along its length. Positioned at the intersection of filling edge 5 and side fold 7 is notch 8. Notch 8 is generally formed by removing a segment of upper layer material defined by the upper side fold at the upper filling edge.

Figure 15:
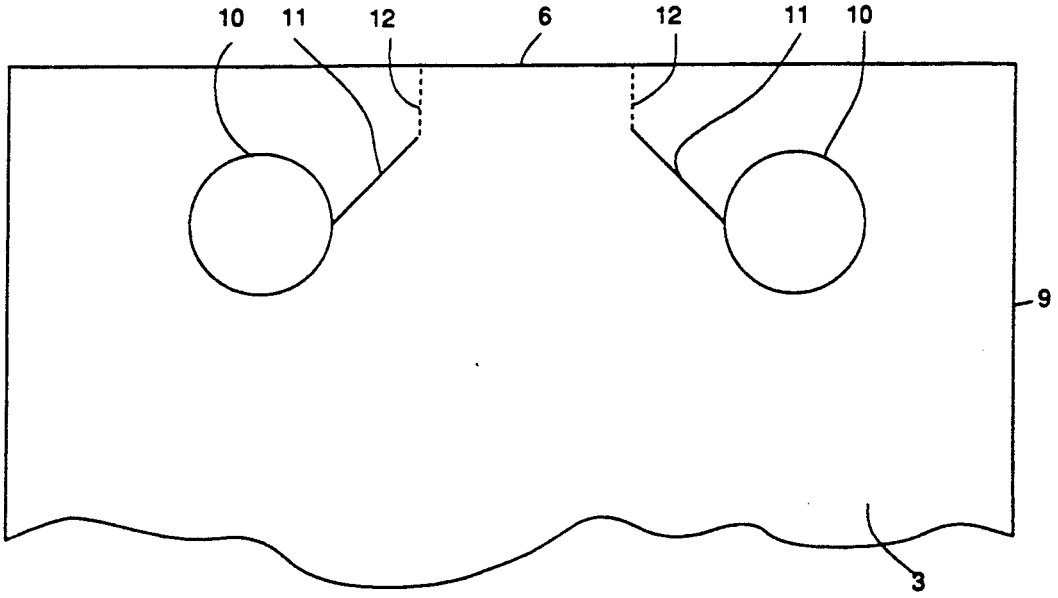
Figure 16:
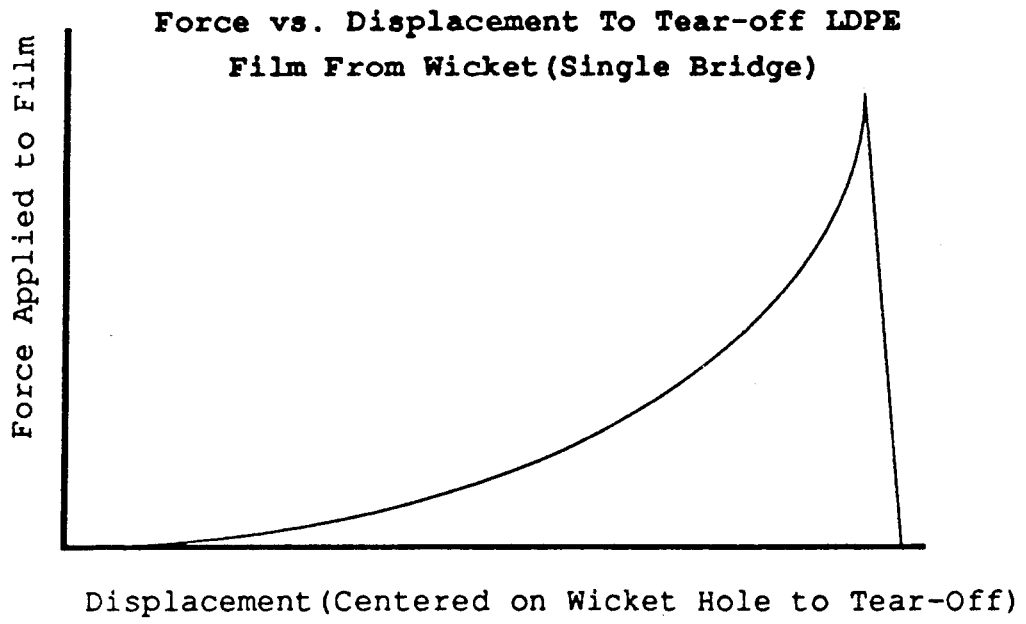
FIG. 16 is a graph showing force versus displacement to tear-off a single bridge of low density polyethylene film from a wicket.
Figure 17:
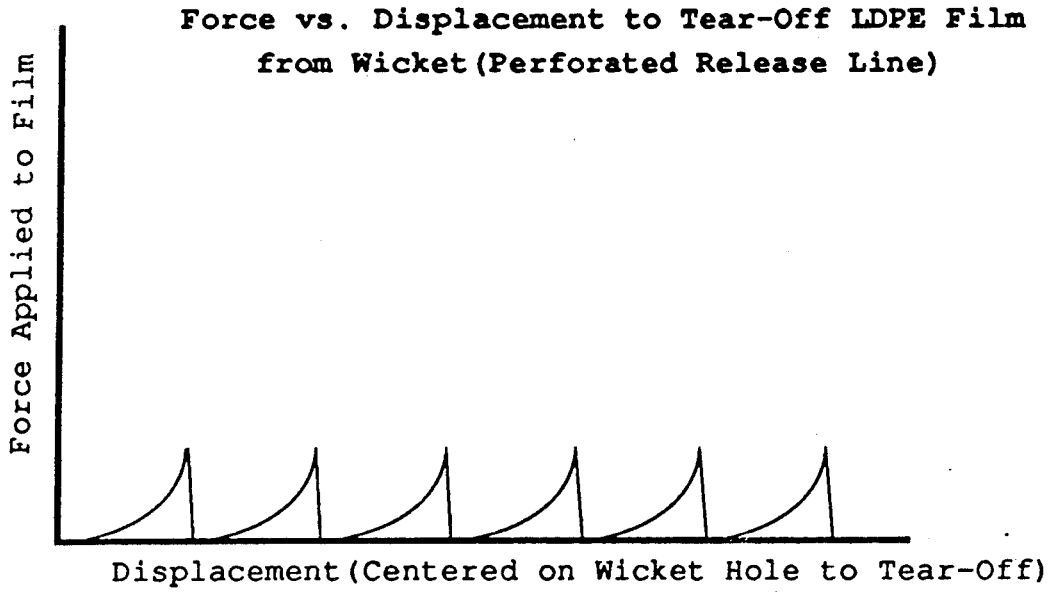
FIG. 17 is a graph showing force versus displacement to tear-off a bridge of low density polyethylene film having a perforated release line from a wicket.

Below gusset fold 4 is lower layer 3 having lower filling edge 6 and lower side fold 9. In lower layer 3 there are formed wicket openings 10 adapted to receive storage wickets and filling mandrels (not shown) and having extending therefrom stabilizing cuts 11 and release paths 12. In the preferred embodiment, stabilizing cut 11 is oriented parallel to lower filling edge 6 and perpendicular to release path 12. Alternatively, stabilizing cut 11 may have an angular orientation with respect to filling edge 6. Preferably still, the angular orientation of said stabilizing cut will be approximately 45 degrees or less as measured from a line parallel to filling edge 6. This is shown in greater detail in FIG. 15.

Figure 2:
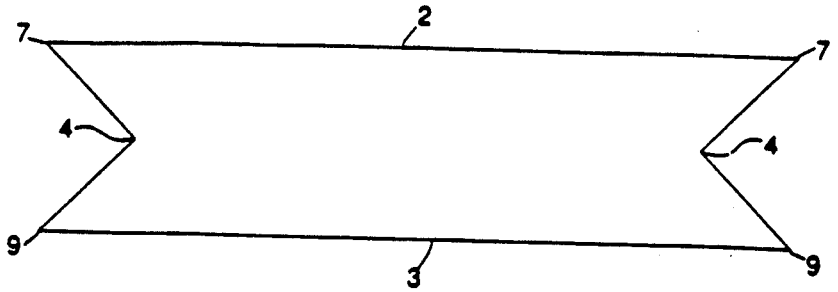
FIG. 2 is a cross-sectional view of a portion of the panel orientation of a side-gusseted bag of the present invention.

FIG. 2 is a cross-sectional view of a portion of the panel orientation of a side-gusseted bag of the present invention at line 2—2 of FIG. 1.

Figure 3:
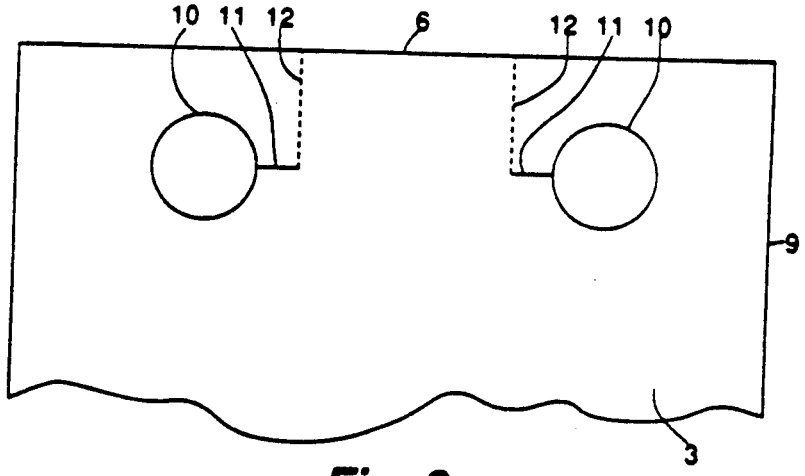
FIG. 3 is a plan view indicating the orientation and placement of the stabilizing cut and release path of the present invention.

FIG. 3 is a plan view showing the orientation and placement of the stabilizing cut and release path of the present invention. Wicket openings 10 are positioned generally a short distance from lower filling edge 6. In the preferred embodiment, two symmetrically placed wicket openings are employed. In alternative embodiments a single or multiple wicket openings may be employed.

In the preferred embodiment, stabilizing cut 11 is formed from a continuous cut and release path 12 is formed from a line of perforations. Alternatively, as shown in FIGS. 7, 8, 9 and 10, stabilizing cut 11 may be formed from a line of perforations or from a combination of short perforation lines and one or more longer continuous cuts. Similarly, as shown in FIGS. 11, 12, 13 and 14, release path 12 may be formed from a continuous cut or from one or more continuous cuts in conjunction with perforations.

Figure 5:
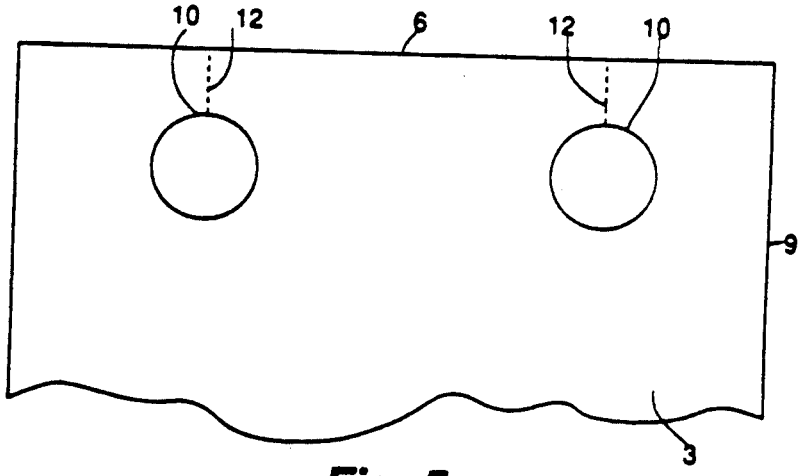
FIG. 5 is an alternate embodiment of the release path shown in FIG. 2.

In other alternative embodiments, stabilizing cut 11 may be employed without release path 12. Alternatively still, as shown in FIG. 5, release path 12 may be employed without stabilizing cut 11 by positioning release path 12 between wicket opening 10 and filling edge 6.

Figure 4:
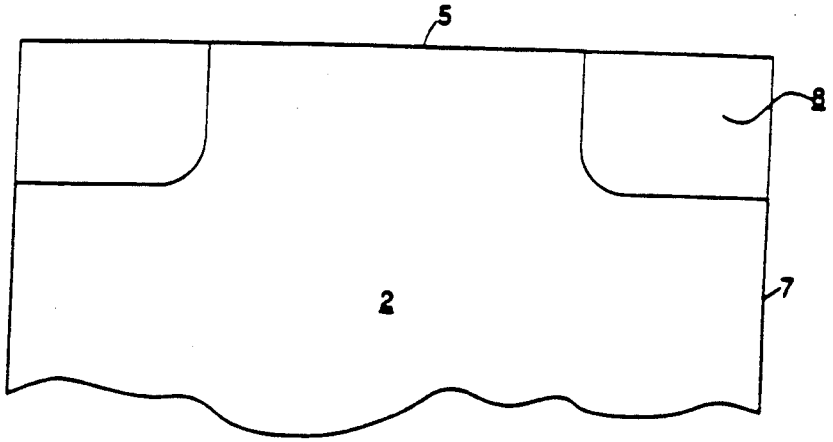
FIG. 4 is a plan view illustrating the upper layer of a side-gusseted bag produced in accordance with the present invention.

FIG. 4 is a plan view illustrating the upper layer of a side-gusseted bag produced in accordance with the present invention. Notch 8 extends deep enough into upper layer 2 so that upper layer 2 will not be restricted by the filling mandrels during loading.

Figure 6:
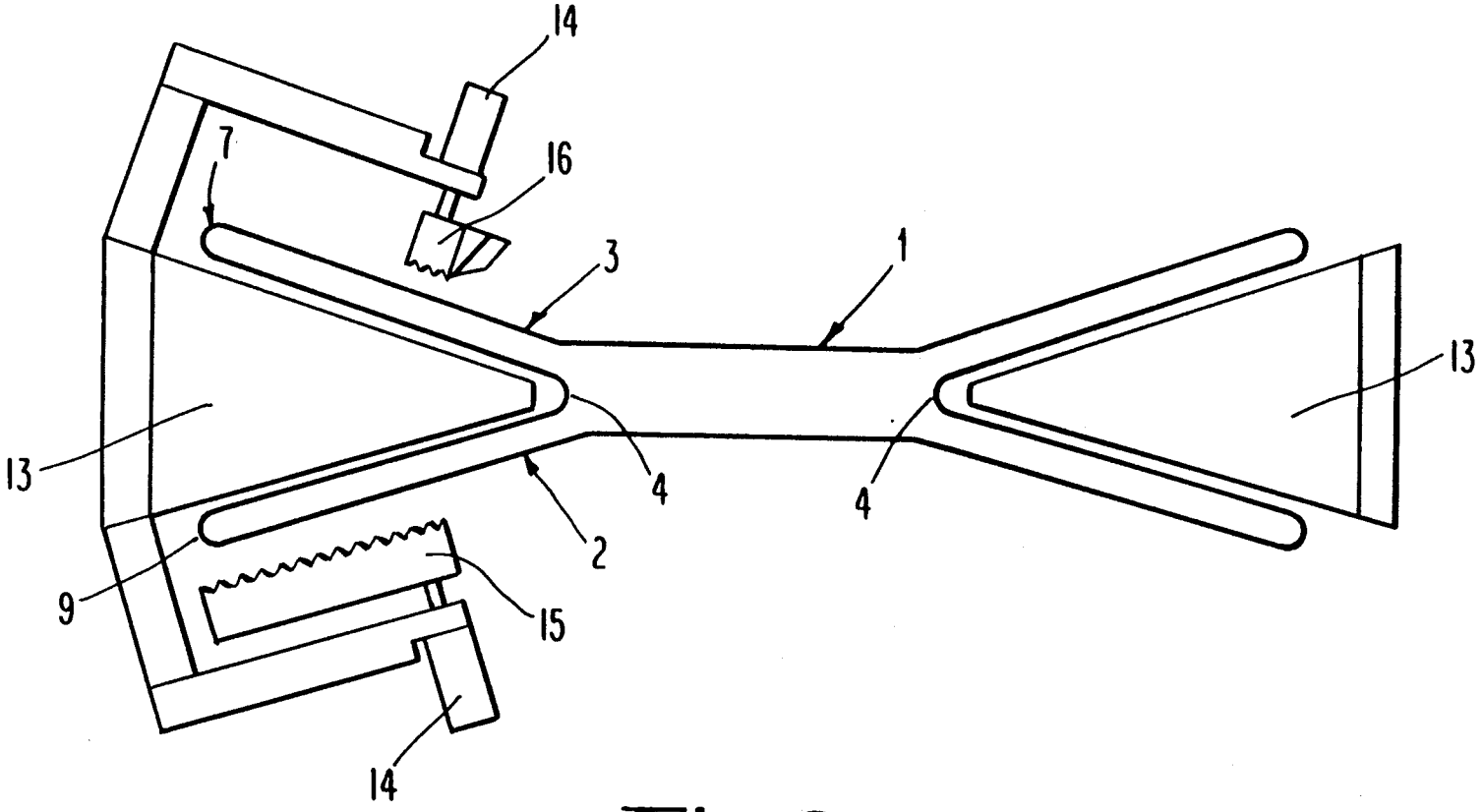
FIG. 6 is a cross-sectional view showing a device for forming the wicket hole and the stabilizing cut and release path of the invention shown in FIG. 1.
Figure 7:
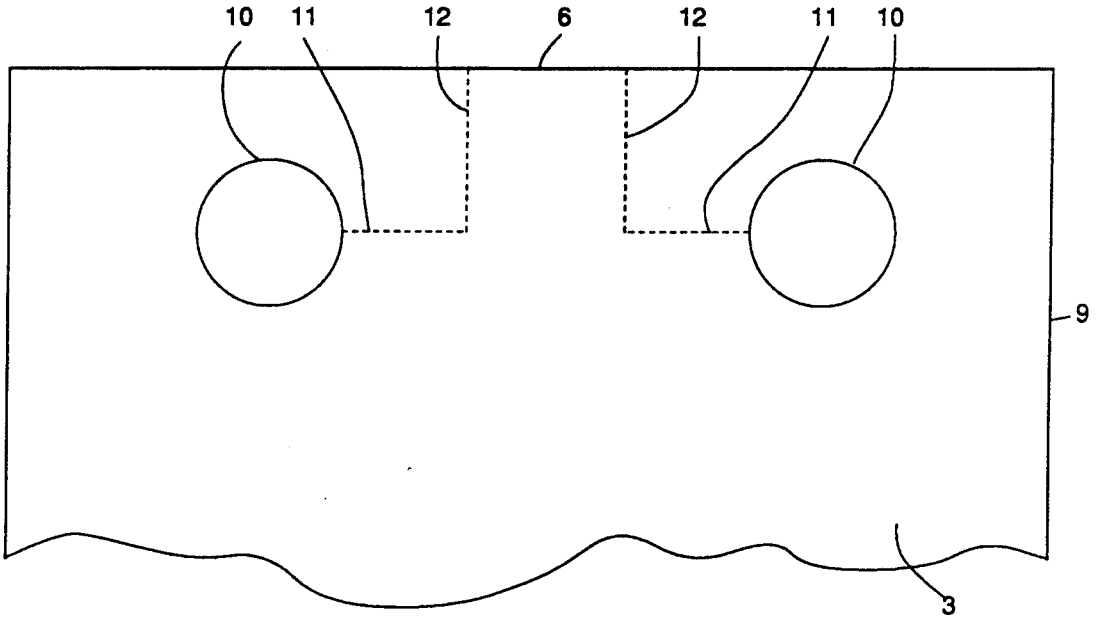
FIGS. 7–15 show alternative embodiments of the stabilizing cut and release path shown in FIG. 3.
Figure 8:
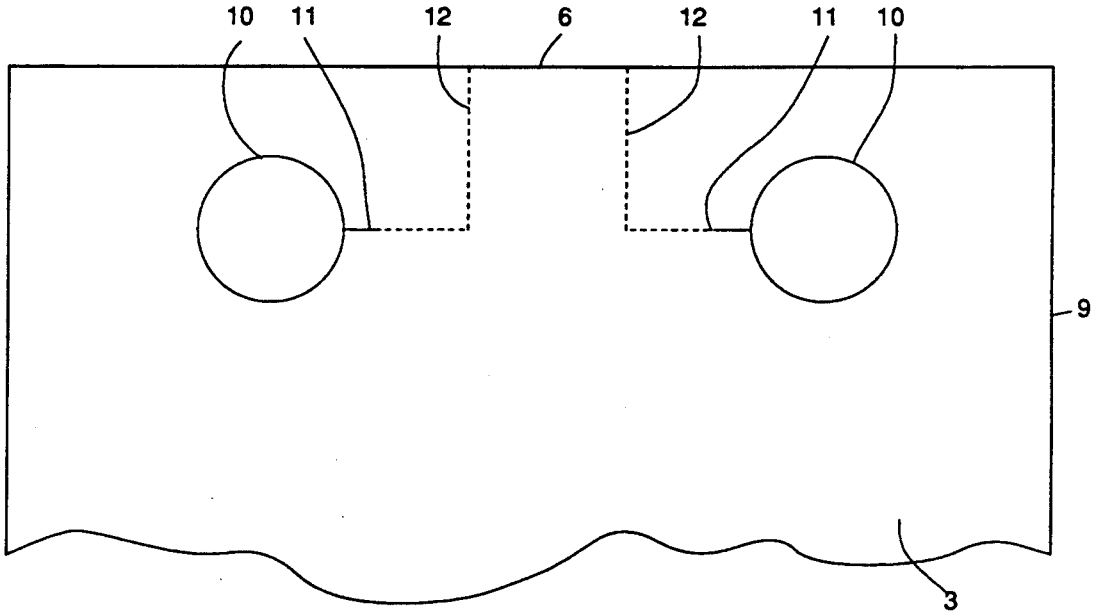
Figure 9:
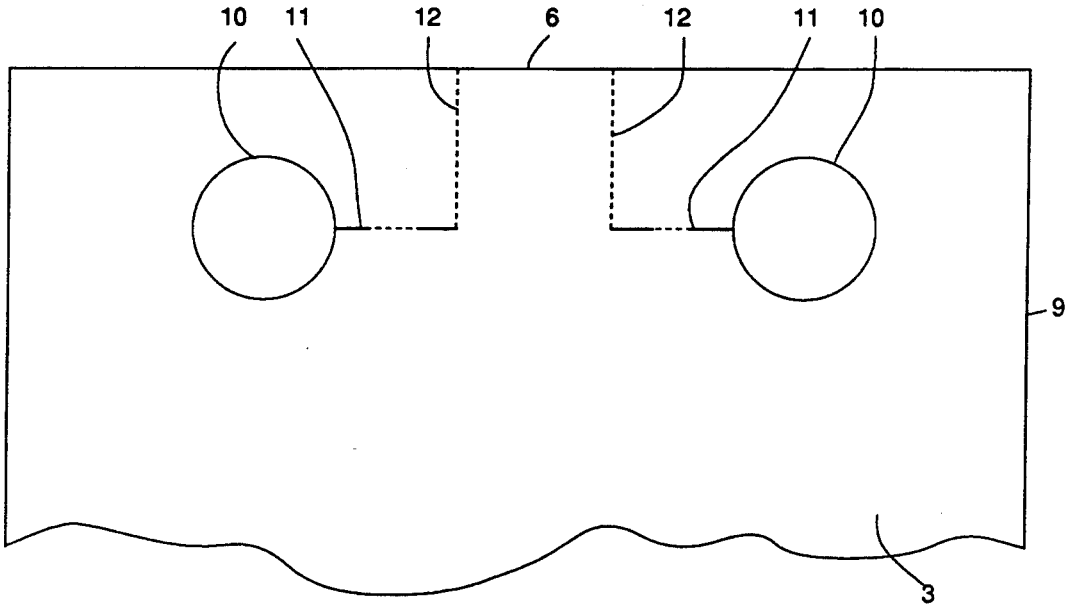
Figure 10:
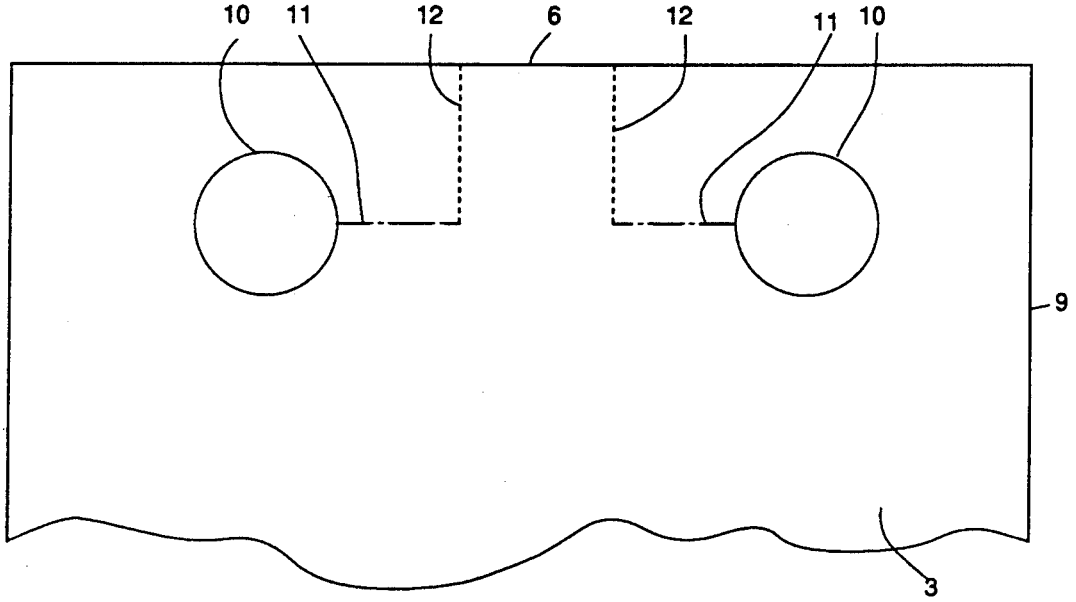
Figure 11:
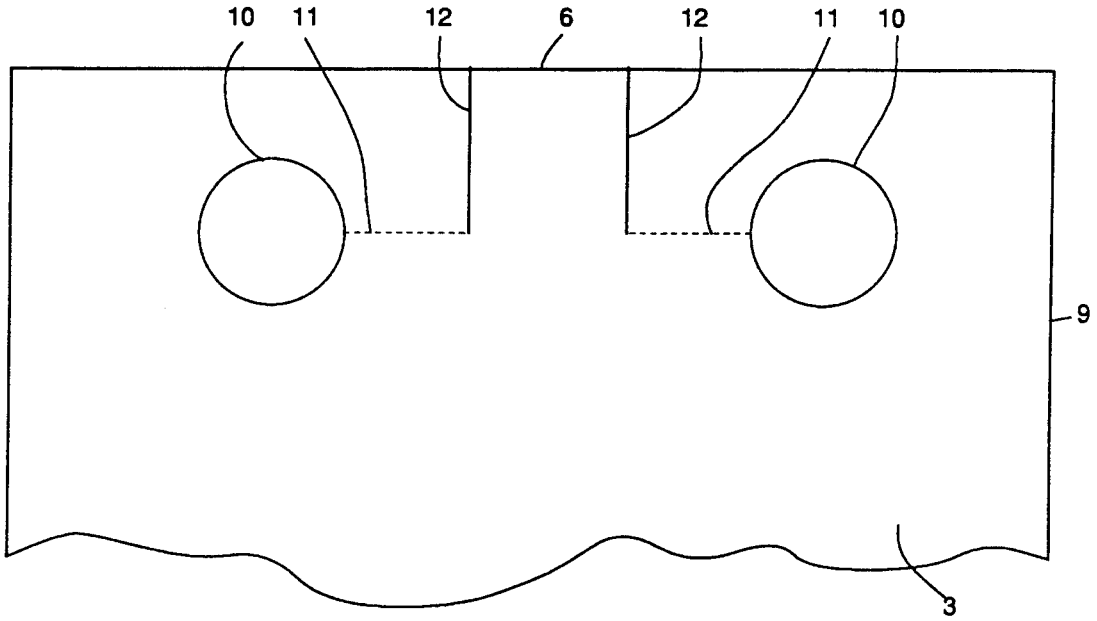
Figure 12:
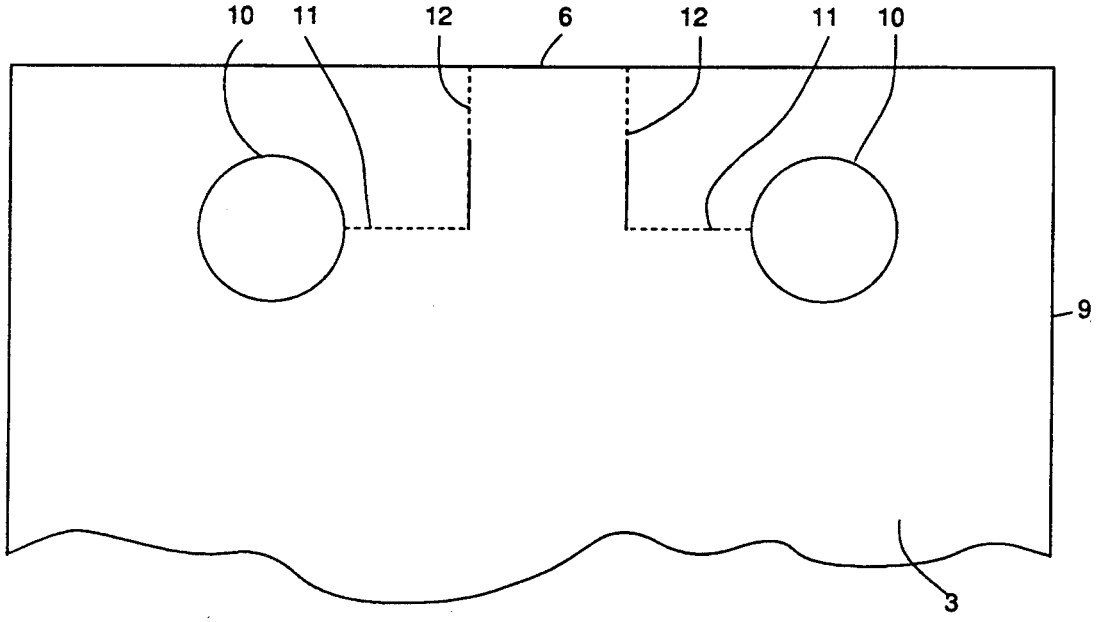
Figure 13:
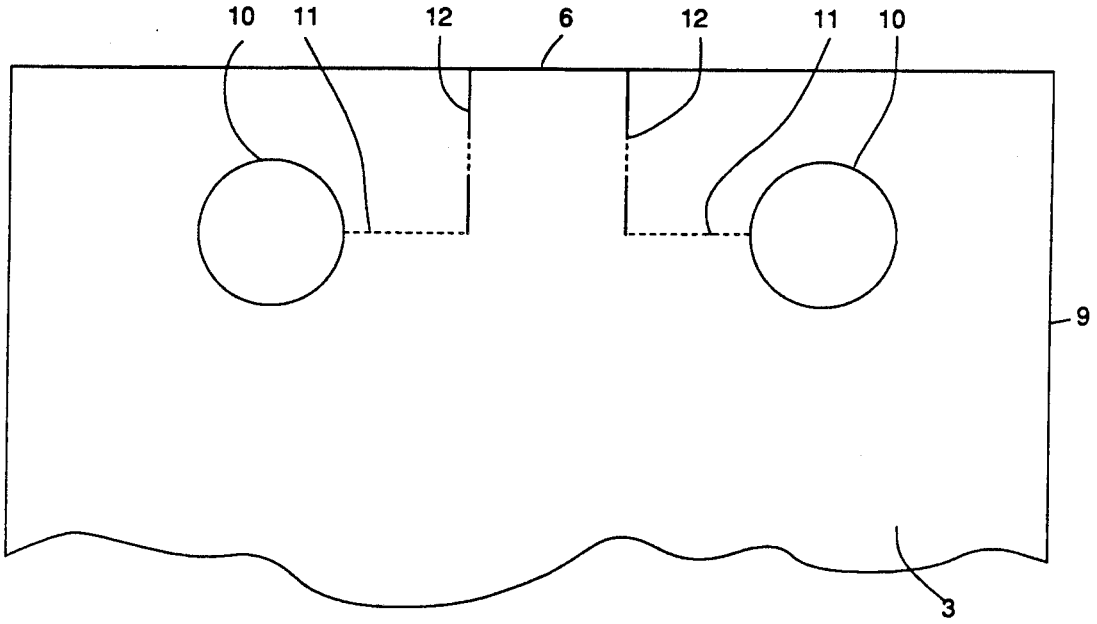
Figure 14:
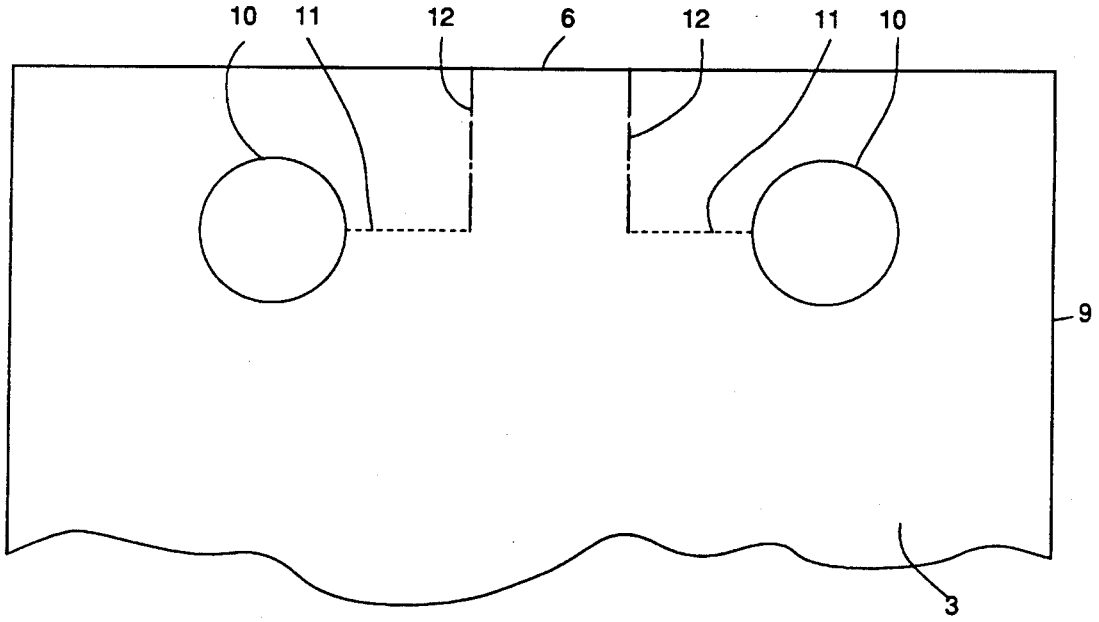

FIG. 6 is a cross-sectional view showing a device for forming the wicket hole and the stabilizing cut and release path of the bag of the present invention from a continuous tube of material. As the folded and gusseted bag tube proceeds through a bag manufacturing process, a generally wedged shaped die 13 is placed in contact with portions of the bag defined by upper side fold 7, gusset fold 4 and lower side fold 9. As the bag is drawn over wedge 13, actuating means 14 activate opposed punch assemblies 15 and 16. Punch assembly 15 forms notch 8 (not shown) while punch assembly 16 forms wicket opening 10, stabilizing cut 11 and release path 12. In the preferred embodiment, wedge 13 includes one or more suction ports which provide an airflow for entraining and removing waste bag material produced in punching.

The present invention may be embodied in other specific forms without departing from the spirit or essential attributes of the invention. Accordingly, reference should be made to the appended claims, rather than to the foregoing specification, as indicating the scope of the invention.

What is claimed is:

1. A multilayered bag of plastic material having a filling edge and being securable to a filling mandrel comprising:

(A) a wicket opening;

(B) a stabilizing cut having first and second ends; and (C) a release path, said stabilizing cut being formed from a weakened line of bag material, said first end extending from said wicket opening to said release path, said release path extending from said stabilizing cut to the filling edge of the bag, said release path being formed from a weakened line of bag material, said stabilizing cut being oriented so as to form an acute angle with a geometric ray having an origin at said first end and a direction parallel to said filling edge.

2. The bag of claim 1 wherein said stabilizing cut is oriented substantially parallel to the filling edge of the bag.

3. The bag of claim 1 wherein said stabilizing cut is a single continuous cut.

4. The bag of claim 1 wherein said stabilizing cut is a line of perforations.

5. The bag of claim 1 wherein said stabilizing cut is in part a line of perforations, the remainder of said stabilizing cut being a continuous cut.

6. The bag of claim 1 wherein said stabilizing cut is formed in part from multiple lines of perforations, the remainder of said stabilizing cut being a continuous cut.

7. The bag of claim 1 wherein said release path is a line of perforations.

8. The bag of claim 1 wherein said release path is formed in part from a line of perforations, the remainder of said release path being formed from a continuous cut.

9. The bag of claim 1 wherein said release path is formed in part from multiple lines of perforations, the remainder of said release path being formed from a continuous cut.

10. A multilayered bag of plastic material having a filling edge and being securable to a filling mandrel comprising:

(A) a wicket opening;

(B) a stabilizing cut having first and second ends, said stabilizing cut being a single continuous cut; and (C) a release path, said stabilizing cut being oriented substantially parallel to the filling edge of the bag, said first end extending from said wicket opening to said release path, said release path extending from said second end to the filling edge of the bag and being substantially perpendicular to said stabilizing cut, said release path being formed from a line of perforations in the bag material.

11. A multilayered bag of plastic material having a filling edge and being securable to a filling mandrel comprising:

(A) a wicket opening;

(B) a stabilizing cut having first and second ends, said stabilizing cut being a single continuous cut, said first end extending from said wicket opening, said stabilizing cut being oriented substantially parallel to the filling edge of the bag; and (C) a release path extending from said wicket opening to the filling edge of the bag, said release path being formed from a line of perforations in the bag material.

* * * * *